US006058278A

United States Patent [19]

Tsuda et al.

[11] Patent Number: 6,058,278

[45] **Date of Patent: *May 2, 2000**

[54] TONER CONTAINER, PROCESS CARTRIDGE AND ELECTROPHOTOGRAPHIC IMAGE FORMING APPARATUS

[75] Inventors: Tadayuki Tsuda, Hachioji; Kazuyoshi Odagawa, Koshigaya; Atsushi Kubota, Machida; Norio Hikake, Yokohama; Shinichi Sasaki, Fujisawa; Isao Ikemoto, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/644,187

[22] Filed: May 10, 1996

[30] Foreign Application Priority Data

May 16, 1995 [JP] Japan ..... 7-117367

[51] Int. Cl.[7] ..... G03G 15/08

[52] U.S. Cl. ..... 399/106; 399/258; 399/262

[58] Field of Search ..... 399/103, 105, 399/106, 258, 262

[56] References Cited

U.S. PATENT DOCUMENTS

| | | | |
|---|---|---|---|
| 4,969,557 | 11/1990 | Oka | 222/DIG. 1 X |
| 4,998,140 | 3/1991 | Satou et al. | 399/105 |
| 5,030,998 | 7/1991 | Shibata et al. | 399/106 |
| 5,134,441 | 7/1992 | Nagata et al. | 355/245 |
| 5,142,335 | 8/1992 | Sakata et al. | 399/106 |

(List continued on next page.)

FOREIGN PATENT DOCUMENTS

| | | |
|---|---|---|
| 0 400 623 | 12/1990 | European Pat. Off. . |
| 59-61861 | 4/1984 | Japan . |
| 59-188679 | 10/1984 | Japan . |
| 62-127876 | 6/1987 | Japan . |
| 62-110954 | 7/1987 | Japan . |
| 1-193872 | 8/1989 | Japan . |
| 1-31767 | 12/1989 | Japan . |
| 2-281277 | 11/1990 | Japan . |
| 3-210582 | 9/1991 | Japan . |
| 4-1784 | 1/1992 | Japan . |
| 6-75474 | 3/1994 | Japan . |
| 7-230207 | 8/1995 | Japan . |

OTHER PUBLICATIONS

Patent Abstracts of Japan, vol. 011, No. 345, Nov. 12, 1987, English Abstract of Japanese Patent No. 62–127876.

Patent Abstracts of Japan, vol. 008, No. 165, Jul. 31, 1984, English Abstract of Japanese Patent No. 59–061861.

Patent Abstracts of Japan, vol. 014, No. 122, Mar. 7, 1990, English Abstract of Japanese Patent No. 01–316767.

Patent Abstracts of Japan, vol. 013, No. 488, Nov. 7, 1989, English Abstract of Japanese Patent No. 01–193872.

Patent Abstracts of Japan, vol. 050, No. 050, Mar. 5, 1985, English Abstract of Japanese Patent No. 59–188679.

*Primary Examiner*—William Royer

*Attorney, Agent, or Firm*—Fitzpatrick, Cella, Harper & Scinto

[57] ABSTRACT

A toner container for containing therein toner used for development by a developing device for developing a latent image formed on an electrophotographic photosensitive member is provided. The developing device is supported by a developing frame, and the toner container is mounted in an electrophotographic image forming apparatus. The toner container having a toner frame has a toner containing portion containing the toner therein, a toner supply opening for supplying the toner contained in the toner containing portion to the developing device, and a toner seal for openably sealing the toner supply opening. A take-up member, disposed in a space formed by the developing frame and the toner frame being coupled together, is provided for taking up the toner seal. A drive force imparting device is provided for imparting a drive force to the take-up member.

50 Claims, 9 Drawing Sheets

U.S. PATENT DOCUMENTS

| | | | |
|---|---|---|---|
| 5,208,634 | 5/1993 | Ikemoto et al. | 355/215 |
| 5,331,372 | 7/1994 | Tsuda et al. | 355/200 |
| 5,341,196 | 8/1994 | Hodoshima et al. | 399/106 X |
| 5,345,294 | 9/1994 | Nomura et al. | 355/200 |
| 5,404,198 | 4/1995 | Noda et al. | 355/200 |
| 5,470,635 | 11/1995 | Shirai et al. | 428/131 |
| 5,475,470 | 12/1995 | Sasago et al. | 355/210 |
| 5,488,459 | 1/1996 | Tsuda et al. | 355/211 |
| 5,500,714 | 3/1996 | Yashiro et al. | 355/200 |
| 5,510,878 | 4/1996 | Noda et al. | 355/211 |
| 5,513,679 | 5/1996 | Yamada | 399/103 X |
| 5,621,507 | 4/1997 | Nishimura et al. | 399/262 X |

TONER CONTAINER, PROCESS CARTRIDGE AND ELECTROPHOTOGRAPHIC IMAGE FORMING APPARATUS

BACKGROUND OF THE INVENTION

1. Field of the Invention

This invention relates to a toner container, a process cartridge and an electrophotographic image forming apparatus.

Here, the toner container is a container for containing therein a toner used to develop a latent image formed on an electrophotographic photosensitive member.

Also, the term "electrophotographic image forming apparatus" covers, for example, an electrophotographic copying apparatus, an electrophotographic printer (such as an LED printer or a laser printer), an electrophotographic facsimile apparatus and an electrophotographic word processor.

Also, the process cartridge refers to charging means, developing means or cleaning means and an electrophotographic photosensitive member integrally made into a cartridge which is removably mountable with respect to the body of the image forming apparatus, and at least one of charging means, developing means and cleaning means and an electrophotographic photosensitive member integrally made into a cartridge which is removably mountable with respect to the body of the image forming apparatus, and further refers to at least developing means and an electrophotographic photosensitive member integrally made into a cartridge which are removably mountable with respect to the body of the image forming apparatus.

2. Description of the Related Art

Heretofore, in an image forming apparatus using the electrophotographic image forming process, there has been adopted a process cartridge system whereby an electrophotographic photosensitive member and process means for acting thereon are integrally made into a cartridge which is removably mountable with respect to the body of the image forming apparatus. According to this process cartridge system, the maintenance of the apparatus can be done by a user himself without resorting to a serviceman and therefore, operability could be markedly improved. So, this process cartridge system is widely used in image forming apparatuses.

On the other hand, in this process cartridge system, there is known the technique whereby in the unused state of a supply port for supplying a toner in a developer storing container (hereinafter referred to as the "toner container") to a developing device side, a seal member is sealed by heat welding or the like and in case of its use, the turned-back portion of the seal portion is pulled in the turn-back direction to thereby unseal the seal portion.

Also, the operating force when the process cartridge is mounted in the image forming apparatus, or an automatic opening mechanism in which when the process cartridge is mounted in the image forming apparatus, the turned-back portion of the above-described seal member is wound on a take-up shaft or the like through a power transmitting device such as a motor-driven gear to thereby automatically open the toner seal, is described in Japanese Patent Laid-Open Application No. 1-193872, Japanese Utility Model Laid-Open Application No. 62-110954, Japanese Patent Laid-Open Application No. 62-127876, etc.

Any of the above-described prior art examples are very effective in the process cartridge for enabling the supply of the toner.

The present invention is a further improvement over the above-described prior art examples.

SUMMARY OF THE INVENTION

It is an object of the present invention to provide a toner container, a process cartridge and an electrophotographic image forming apparatus which are improved in operability.

It is another object of the present invention to provide a toner container, a process cartridge and an electrophotographic image forming apparatus in which a toner seal sealing a toner supply port can be automatically taken up.

It is still another object of the present invention to provide a toner container, a process cartridge and an electrophotographic image forming apparatus in which a toner supply port can be unsealed.

It is yet still another object of the present invention to provide a toner container, a process cartridge and an electrophotographic image forming apparatus which have a take-up member for taking up a toner seal sealing a toner supply port, and a drive force receiving member for receiving a drive force for driving the take-up member.

It is a further object of the present invention to provide a toner container, a process cartridge and an electrophotographic image forming apparatus in which after the unsealing of a toner seal, toner can be prevented from leaking from a developing device or the process cartridge and moreover the operability of the unsealing operation of the toner seal is good.

It is still a further object of the present invention to provide a toner container, a process cartridge and an electrophotographic image forming apparatus in which the take-up process of a seal member can be carried out in a hermetically sealed space and after the unsealing of the seal member, developer does not leak out of the apparatus and for the take-up of the seal member, a force required for the unsealing of the seal member can only be taken into account and therefore the seal member can be reliably taken up.

DESCRIPTION OF THE PREFERRED EMBODIMENTS

[First Embodiment]

Figure 1:
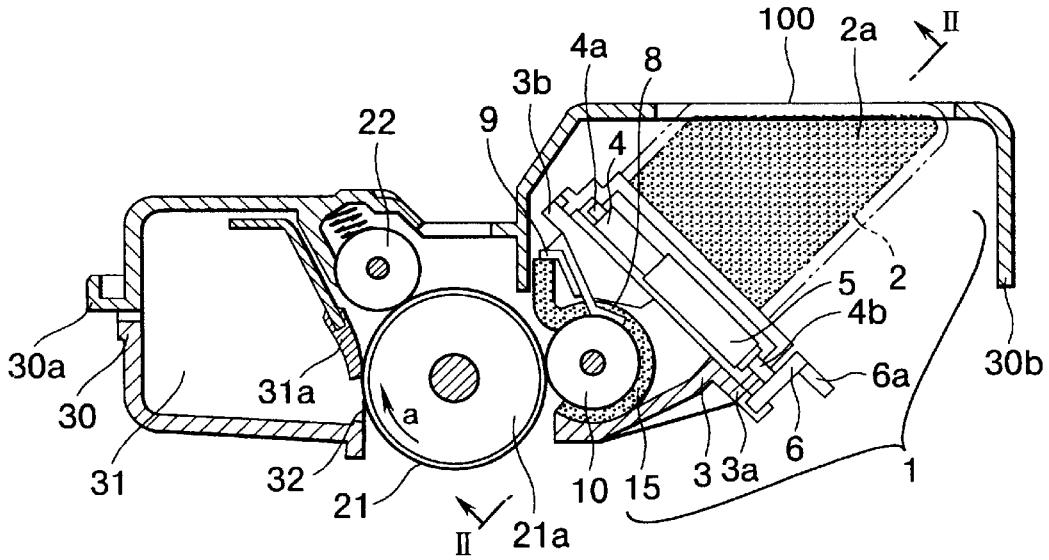
FIG. 1 is a side cross-sectional view of a developing device showing a first embodiment of the present invention and a process cartridge constituting it.
Figure 2:
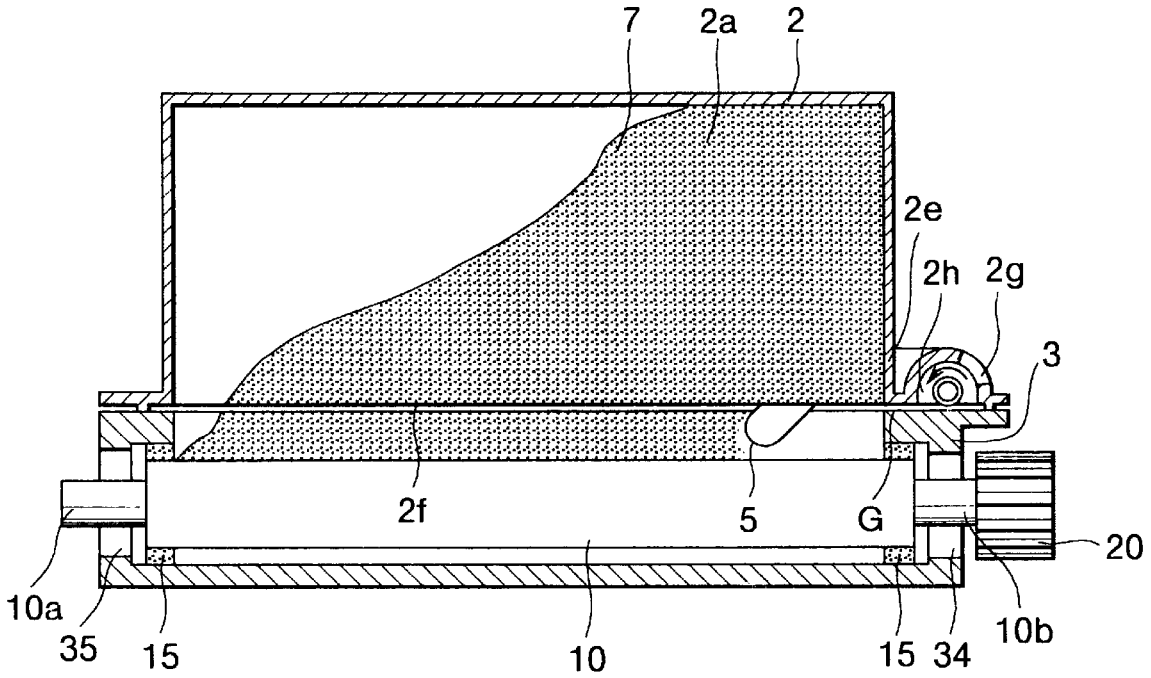
FIG. 2 is a cross-sectional view taken along the line II—II of FIG. 1.
Figure 9:
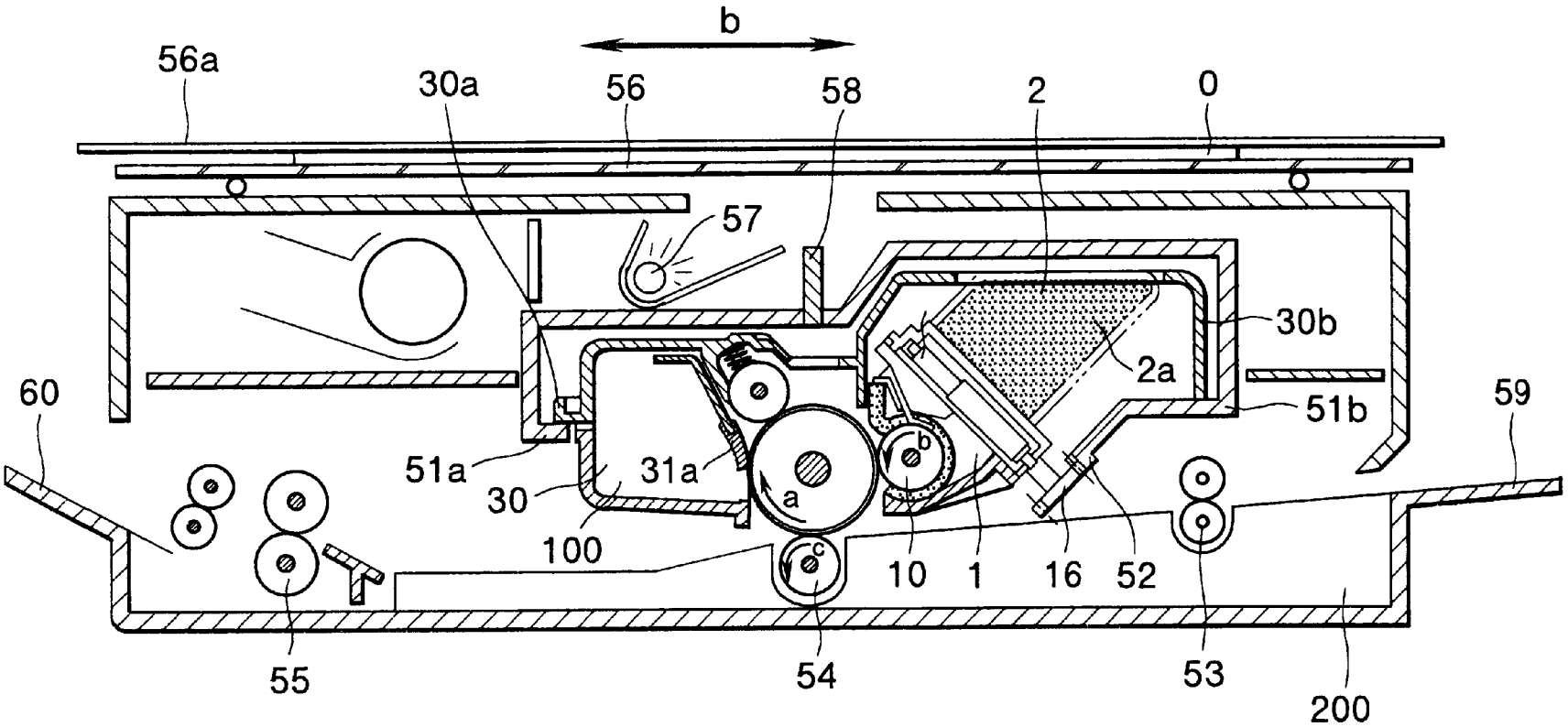
FIG. 9 is a cross-sectional view of an image forming apparatus in which the process cartridge is mounted.

FIG. 1 is a side cross-sectional view of a process cartridge having a developing device, FIG. 2 is a cross-sectional view taken along the line II—II of FIG. 1, and FIG. 9 is a cross-sectional view of portions of an electrophotographic image forming apparatus for forming an image on a recording medium by the use of the electrophotographic method in which the process cartridge of FIG. 1 is mounted.

A photosensitive drum 21 is journalled to a frame member 30 for rotation in the direction of arrow a, and around it, there are disposed a charger 22, a short-focus optical element 58, a developing device 1, a transfer charger 54 and a cleaning device 31 in accordance with the direction of rotation of the drum. In the present embodiment, with the photosensitive drum 21, the charger 22, the developing device 1 and the cleaning device 31 are integrally supported by the frame member 30 to thereby constitute a process cartridge 100. The process cartridge 100 of the present embodiment is supported and guided by guide rails 51*a* and 51*b* secured to a body of image forming apparatus 200 (hereinafter referred to as the "apparatus body") and is adapted to be mounted and dismounted with respect to the apparatus body 200. In the present embodiment, the process cartridge 100 is inserted from this side in the plane of the drawing sheet of FIG. 9 toward the inner side, whereby it is mounted in the apparatus body 200.

The image forming apparatus in the present embodiment uniformly charges the surface of the photosensitive drum 21 by the charger 22. Then, an original O on an original supporting table 56 on the upper portion of the apparatus body which is reciprocally moved (in the direction of arrow b) is illuminated by a lamp 57, and the reflected light therefrom is applied onto the photosensitive drum 21 through the short-focus optical element 58 to thereby form a latent image on the photosensitive drum. The formed latent image is developed by the developing device 1, and the toner image is transferred to a transfer material by a transfer charger 54. The transfer material (such as recording paper or OHP sheet) is manually supplied onto a paper supply tray 59 by an operator and is conveyed to a transfer station through conveying rollers 53. After the termination of the transfer, the transfer material is separated from the photosensitive drum 21, is sent to a fixating device 55 through a conveyance path, has the toner image thereon fixated thereby, and is discharged onto a paper discharge tray 60. The reference character 56*a* designates an original cover which covers the original placed on the original supporting table 56. Also, the photosensitive drum 21 from which the toner image has been transferred to the transfer material has any toner remaining thereon removed by the cleaning blade 31*a* of the cleaning device 31.

On the other hand, the developing device 1 in the process cartridge 100 has its developing roller 10 rotatably supported on a housing member 3 constituting a developing device housing, through shafts 10*a*, 10*b* and bearings 34, 35, and the gap between the developing roller 10 and the photosensitive drum 21 is ensured at a predetermined value by a dashing roller (not shown).

A drive gear 20 is mounted on one end of the developing roller 10 and is in meshing engagement with a drum gear 21*a* mounted on one end side of the photosensitive drum 21 and is thus rotated in synchronism with the rotation of the photosensitive drum 21. A blade 8 is sandwiched between the ridge portion 3*b* of the housing member 3 and a blade metal sheet 9 and is in contact with the developing roller 10 with a predetermined pressure force to form a toner layer of a proper thickness on the surface of the developing roller 10. A belt member 15 for sealing is disposed between the opposite end portions of the developing roller 10 and the housing member 3 to prevent the leakage of the toner from the end portions of the housing member 3. The developing roller 10 is rotated to thereby supply the toner to the photosensitive drum 21.

A toner container 2 in which a toner 7 is stored is filled with the toner in a state in which a toner supply opening 2*f* formed on the developing device side is sealed by a toner seal 5 comprising flexible film. When the toner seal 5 is taken up and the opening 2*f* is unsealed, the toner 7 stored in the toner container 2 passes through this opening 2*f* and is supplied to the developing device 1.

Figure 3:
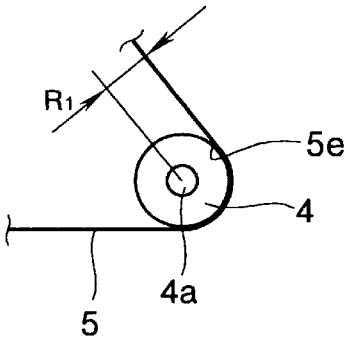
FIG. 3 is a plan view showing the coupled state of a take-up member and a toner seal.
Figure 4:
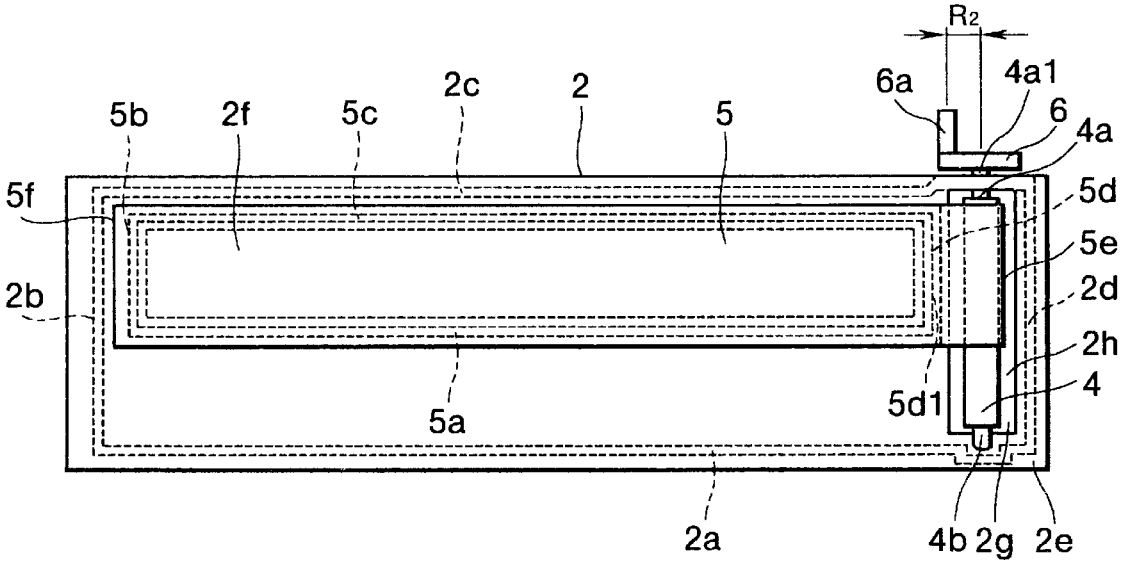
FIG. 4 is a front view of a toner supply opening portion in FIG. 1 (the unsealed state of the toner seal).

The toner seal 5, with its side adjacent to one end of the toner supply opening 2*f* (the drive gear 20 side) as the leading end of the seal, is welded up to its other end side by heat welding portions 5*a*, 5*b*, 5*c* and 5*d*, as shown in FIG. 4. Further, it is turned back toward one end side thereof with the turned-back portion 5*f* of the other end side as a peeling start portion, and that end portion is welded to the surface of a cylindrically shaped take-up member 4 by a heat welding portion 5*e*, as shown in FIG. 3.

The take-up member 4 is contained in a take-up member containing portion 2*h* formed continuously and integrally with one end side wall portion 2*e* of the toner container 2, and the opposite end shaft portions 4*a* and 4*b* thereof are supported on a bearing portion formed on the wall portion of the take-up member containing portion 2*h*. Herein, the member constituting this take-up member containing portion 2*h* is formed integrally with the toner container 2, but alternatively may be formed discretely from the latter.

Figure 5:
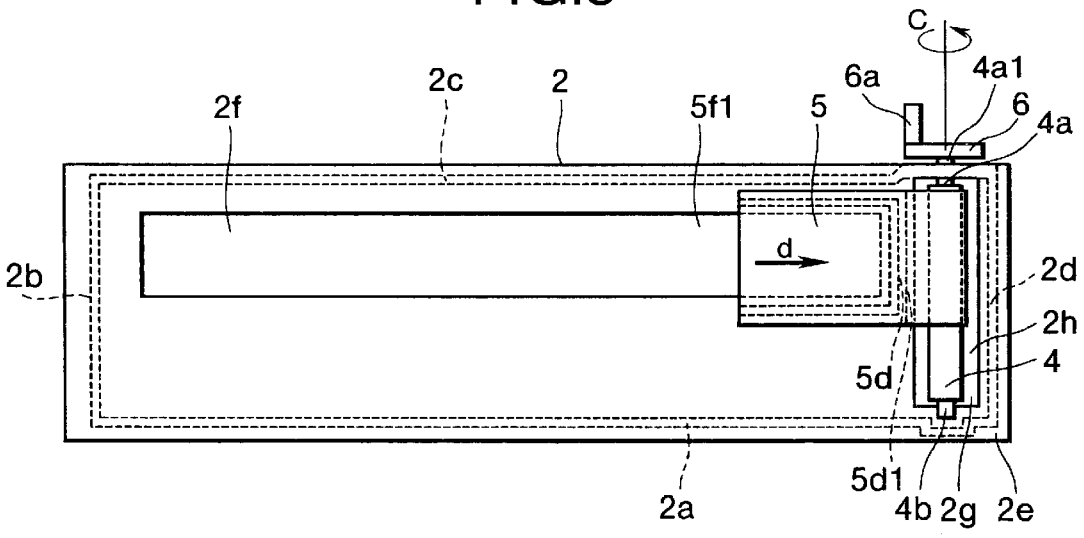
FIG. 5 is a front view of the toner supply opening portion in FIG. 1 (the state of the toner seal being unsealed).

The shaft portion 4*a* of the take-up member 4 extends through the wall portion of the take-up member containing portion 2*h* which forms a bearing portion. A handle 6 forming an input member is mounted on a portion 4*a*1 outwardly protruding through this wall portion. When as shown in FIG. 5, the operator holds the grip portion 6*a* of the handle 6 and turns it in the direction of arrow C, the toner seal 5 can be taken up onto the take-up member 4.

On the other hand, on that wall portion of the toner container 2 in which the toner supply opening 2*f* is formed, ridge-like joint portions 2*a*, 2*b*, 2*c* and 2*d* are formed over the entire periphery thereof in such a manner that the toner supply opening 2*f* and the take-up member containing portion 2*h* are inside thereof. These joint portions 2*a* to 2*d* are joined to the wall portion of the housing member 3 of the developing device 1 as by the heat welding method or the hot melt securing method. Accordingly, the seam between the toner container 2 and the housing member 3 of the developing device 1 is maintained in a hermetically sealed state and the toner does not leak from this seam.

Also, the take-up member 4 and the toner seal 5 are disposed inside the joint portions 2*a* to 2*d* and therefore, the peeling force when the unsealing of the toner seal 5 is done need only be taken into account, and for example, the radius R1 of the take-up member 4 and the operating radius R2 of the handle 6 are brought into the relation that R1<R2, whereby the peeling force for the toner seal 5 can be made small.

The unsealing of the toner seal 5 will be described here. When as shown in FIGS. 4 and 5, the operator turns the handle 6 in the direction of arrow C, a take-up force is applied to the turned-back portion 5*f*1 of the toner seal 5 and the heat welding portion 5*b* is peeled. When the turned-back portion 5*f*1 then moves in the direction of arrow d as the toner seal 5 is taken up, the heat welding portions 5*a* and 5*c* are peeled and finally, the tip end portion 5*d*1 of the seal which is the peeling termination end portion is also peeled and the toner seal is taken up onto the take-up member 4. If a colored mark or the like is attached to this peeling termination end portion 5*d*1, this mark can be confirmed through a window portion 2*g* comprising a transparent member provided in a portion of the wall portion of the take-up member containing portion 2*h* and thus, the operator can visually recognize the take-up terminated state. A one-way clutch, for example, a one-way spring or a one-way ratchet mechanism, may be provided between the handle 6 and the take-up member 4, whereby the direction of rotation of the handle 6 can be prescribed in one take-up direction.

Figure 6:
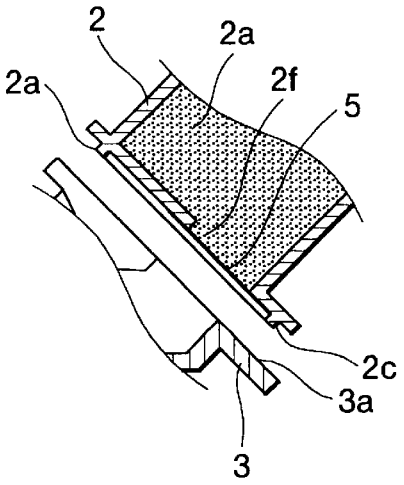
FIG. 6 is a cross-sectional view showing a method of welding a developer container and a developing device together.
Figure 7:
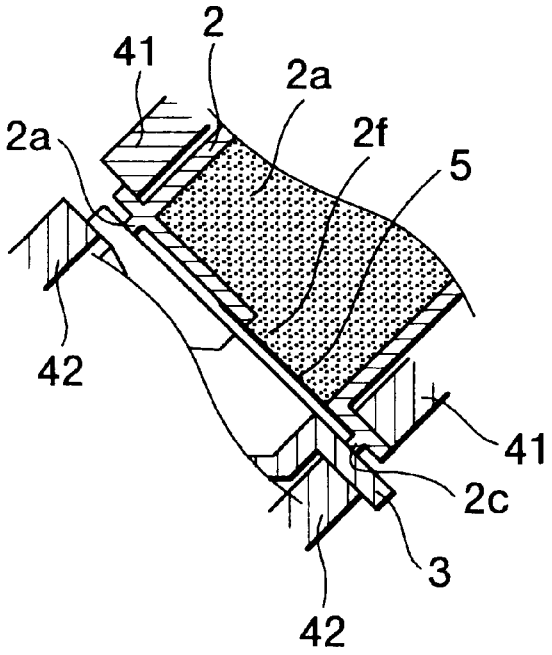
FIG. 7 is a cross-sectional view showing the welded state by the welding method shown in FIG. 6.
Figure 8:
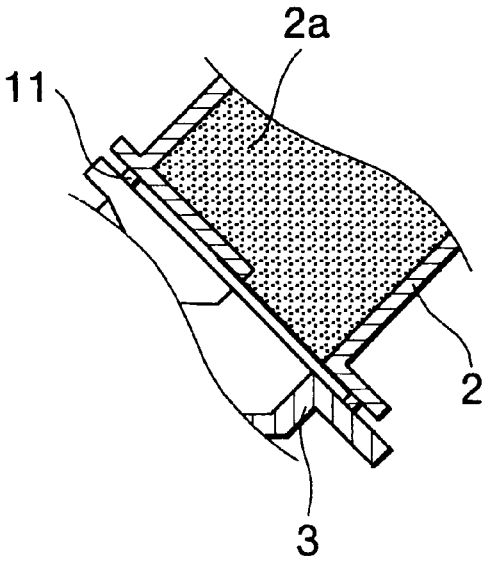
FIG. 8 is a cross-sectional view showing a method of adhesively securing the developer container and the developing device to each other.

A method of joining the toner container 2 and the housing member 3 of the developing device 1 together by heat welding will now be described with reference to FIGS. 6 and 7. The ridge-like joint portions 2*a* to 2*d* and the wall portion 3*a* of the housing member 3 are sandwiched by and between welding jigs 41 and 42 with a predetermined pressure force in such a manner that they bear against one another, and vibration is imparted thereto with this state held, whereby heat welding is effected. According to this heat welding method, the resin materials of said portions are melted and coupled together and therefore, said portions can be firmly coupled together without any gap being formed in the seam. The joint of the toner container 2 and the housing member 3 of the developing device 1 can also be accomplished by pouring a hot melt type adhesive agent 11 into between the joints 2*a* to 2*d* of the ridges and the wall portion of the housing member 3, and melting the adhesive agent 11.

[Second Embodiment]

Figure 10:
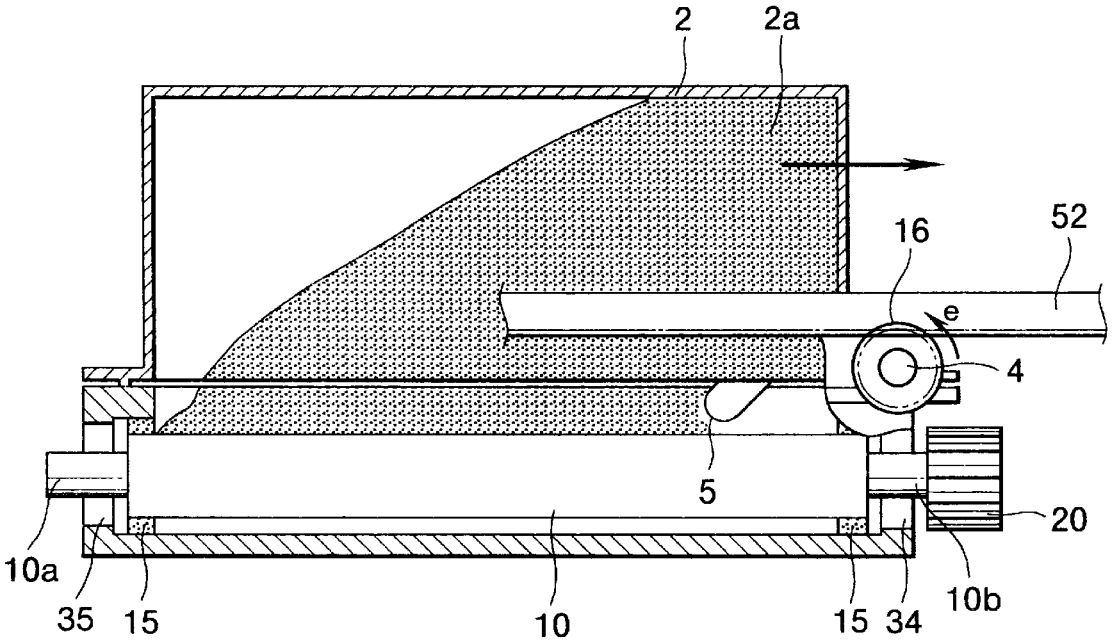
FIG. 10 is a cross-sectional view of a developing device showing a second embodiment of the present invention.
Figure 11:
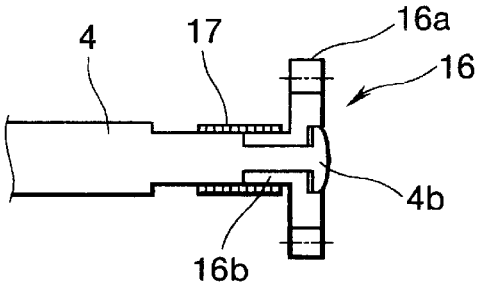
FIG. 11 is a cross-sectional view showing the connected state of a pinion gear and a take-up member in FIG. 10.

Next, a second embodiment of the present invention is shown in FIGS. 10 and 11.

In the above-described first embodiment, design is made such that before the unused process cartridge 100 is inserted into the apparatus body 200 shown in FIG. 9, the operator manually turns the handle 6 which is an input member and takes up the toner seal 5 onto the take-up member 4. However, the second embodiment which will now be described is designed such that the toner seal 5 is automatically taken up onto the take-up member 4 by the operation of inserting the unused process cartridge 100 while supporting and guiding it by the guide rails 51*a* and 51*b* of the apparatus body 200. The joint structure of the toner container 2 and the developing device 1 is similar to that in the first embodiment.

In FIGS. 10 and 11, a gear 16 is rotatably mounted on the rotary shaft 4*b* of the take-up member 4, and the end surface of the rotary shaft 4*b* is heat-caulked for anti-slippage. The gear 16 is comprised of a gear body 16*a* and a tube portion 16*b* mounted on the rotary shaft 4*b*, and the rotary shaft 4*b* and the tube portion 16*b* of the gear 16 can be coupled together through a one-way spring 17. When the gear 16 is rotated in the direction of arrow e which is the take-up direction of the toner seal 5, the one-way spring 17 is tightened and the take-up member 4 is rotated in the take-up direction of the toner seal 5 with the rotary shaft 4*b* and the tube portion 16*b* of the gear 16 as a unit. Also, when the gear 16 is rotated in the opposite direction, the one-way spring 17 is not tightened and therefore, the gear 16 only idly rotates relative to the rotary shaft 4*b* and thus, it never happens that the toner seal 5 slips out from the take-up member 4 due to the reverse rotation of the take-up member 4.

On the other hand, in the apparatus body 200, there is provided a toothed guide member 52 such as a rack meshing with the gear 16 along the direction of insertion of the process cartridge 100, and the gear 16 is rotated in the direction of arrow e in accordance with the insertion of the process cartridge 100 to thereby automatically take up the toner seal 5. The length of the meshing engagement between the toothed guide member 52 and the gear 16 is a length sufficient to take up the toner seal 5. Also, when the process cartridge 100 is taken out of the apparatus body 200, the gear 16 is rotated in a direction opposite to the direction of arrow e, but since the one-way spring 17 is not tightened as described above, it never happens that the toner seal 5 once taken up slips out from the take-up member 4.

In the present embodiment, the one-way spring 17 is used as a one-way mechanism for the rotation of the gear 16 in one direction, but alternatively, use may be made of a one-way rotation transmitting mechanism such as a ratchet system.

[Third Embodiment]

Figure 12:
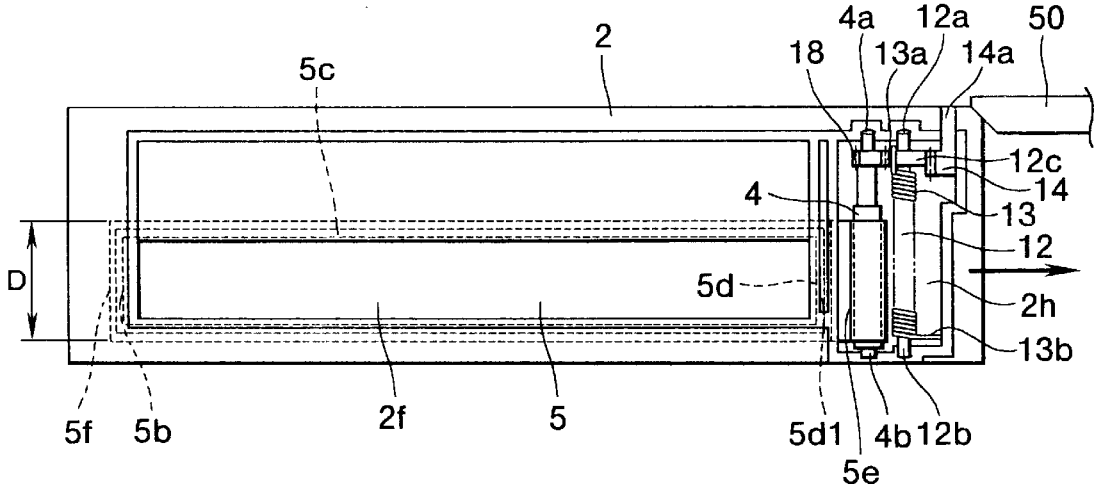
FIG. 12 is a front view of a toner supply opening showing a third embodiment of the present invention (the sealed state thereof).
Figure 13:
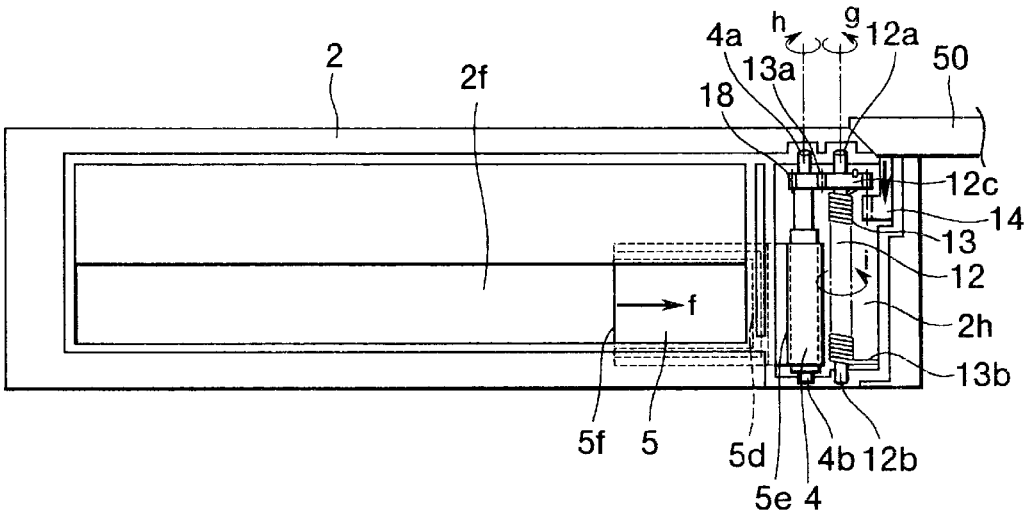
FIG. 13 is a front view of the toner supply opening showing the third embodiment (the state of the opening being unsealed).

A third embodiment of the present invention is shown in FIGS. 12 and 13.

This embodiment is one utilizing the accumulated energy of a spring as a take-up force for automatically taking up the toner seal 5 onto the take-up member 4. In the take-up member containing portion 2*h*, a take-up driving member 12 is juxtaposed with the take-up member 4 and the take-up driving member 12 has its rotary support shaft portions 12*a* and 12*b* supported by the bearing portion of the take-up member containing portion 2*h*, whereby it is made rotatable. A take-up gear 18 is provided integrally with the take-up member 4, and the gear portion 12*c* of the take-up driving member 12 is in meshing engagement with this take-up gear 18. So, when the take-up driving member 12 is rotated in the direction of arrow g, the take-up member 4 is rotated in the direction of arrow h and the toner seal 5 is moved in the direction of arrow f and is thereby taken up. A take-up spring 13 in the form of a coil spring is mounted on the shaft portions 12*a* and 12*b* of the take-up driving member 12, and one end of the take-up spring 13 is engaged with the gear portion 12*c* and the other end 13*b* of the take-up spring 13 is engaged with the toner container 2 side, and the take-up spring is twisted in a direction opposite to the direction of arrow i, whereby the take-up spring is charged with a rotative spring force.

The take-up driving member 12 is held in a state in which it is charged with a spring force sufficient to take up the toner seal 5, and this holding is effected by the toothed portion of a restraining member 14 provided in the take-up member containing portion 2*h* coming into engagement with the gear portion 12*c* of the take-up driving member 12. The restraining member 14 is movable along the axial direction of the take-up driving member 12 and the tip end portion thereof protrudes outwardly through the wall portion of the take-up member containing portion 2*h*. When this protruding end portion is pushed into the take-up member containing portion 2*h*, the engagement thereof with the gear portion 12*c* of the driving member 12 is released. The spring force of the take-up spring 13 then acts in the direction of arrow i and the gear portion 12*c* is rotated in the direction of arrow g, whereby the take-up member 4 is rotated in a direction of arrow h to take up the toner seal 5 and is moved while peeling the toner seal 5 in the direction of arrow f and thus, the toner supply opening 2*f* is unsealed.

In the present embodiment, the operation of pushing in the restraining member 14 is performed by the process cartridge 100 bearing against a releasing member 50 provided in the apparatus body 200 when the process cartridge 100 is inserted into the apparatus body. Also, the joint structure of the toner container 2 and the housing member 3 of the developing device 1 is similar to that in the first embodiment.

[Fourth Embodiment]

Figure 14:
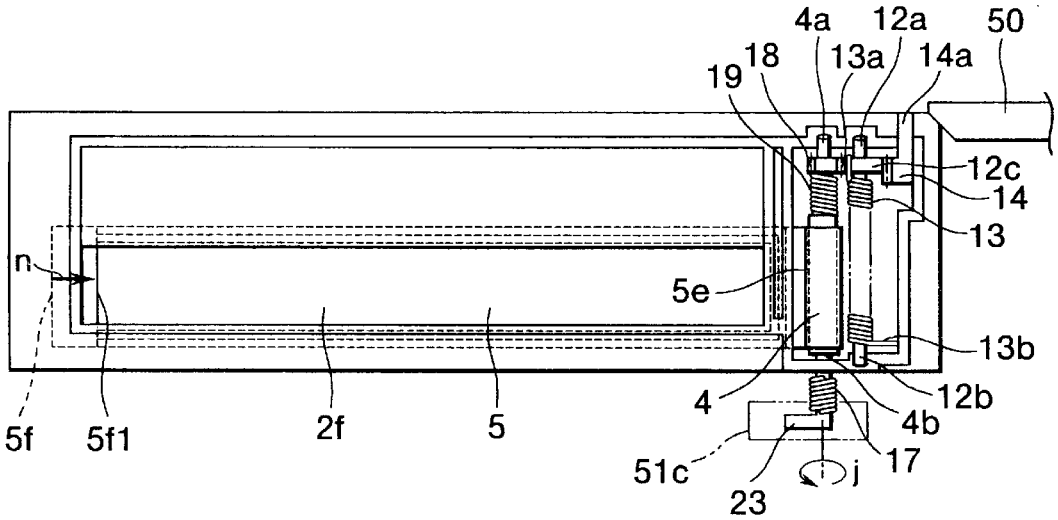
FIG. 14 is a front view of a toner supply opening showing a fourth embodiment of the present invention (the sealed state thereof).
Figure 15:
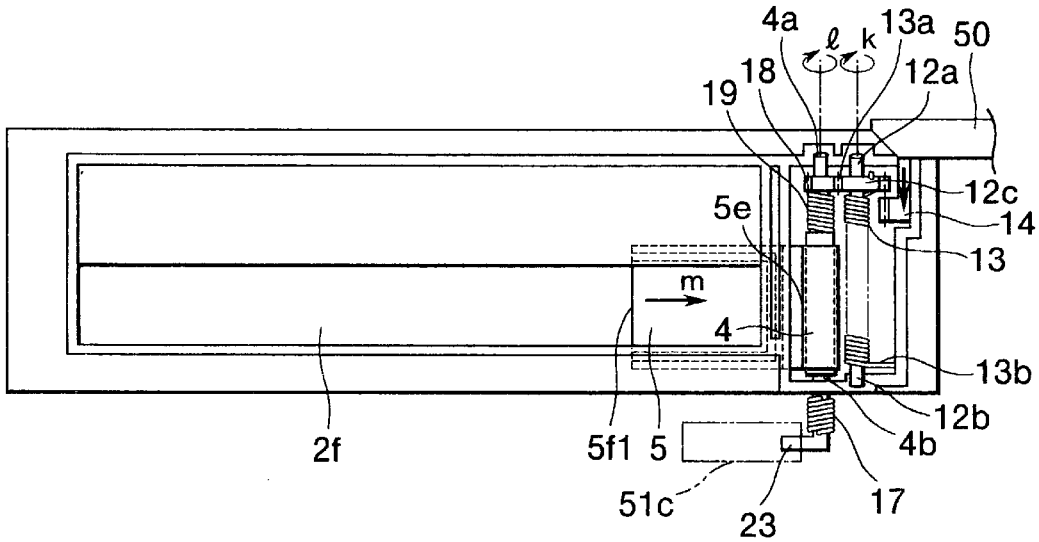
FIG. 15 is a front view of the toner supply opening showing the fourth embodiment (the state of the opening being unsealed).
Figure 16:
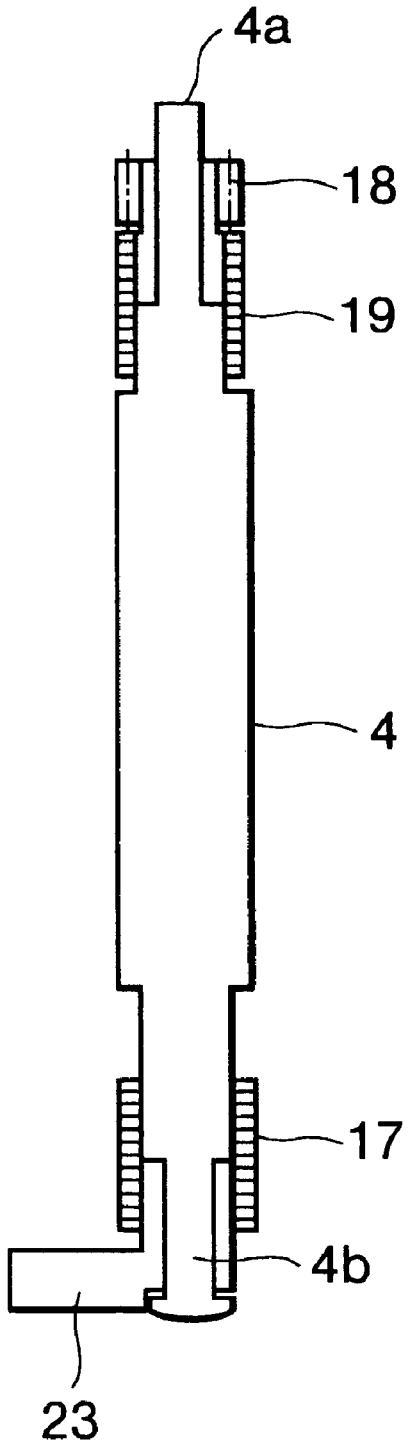
FIG. 16 is a cross-sectional view of a taken-up member shown in FIG. 14.

FIGS. 14, 15 and 16 show a fourth embodiment of the present invention which is similar in basic construction to the third embodiment shown in FIGS. 12 and 13, and only the differences of this embodiment from the third embodiment will hereinafter be described in detail.

In the present embodiment, the take-up member 14 is such that as shown in FIG. 16, a take-up lever 23 is rotatably mounted on the rotary shaft 4*a* through one-way rotation transmitting mechanisms using one-way springs 17 and 19 similar to the spring in FIG. 11 and a take-up gear 18 is provided on the rotary shaft 4*b*. The one-way rotation transmitting mechanism comprised of the one-way spring 17 transmits the rotation of the take-up lever 23 to the take-up member 4 in the toner seal take-up direction for which the take-up lever 23 is rotated in the direction of arrow j, whereby the take-up of the toner seal 5 can be effected.

At this time, the one-way rotation transmitting mechanism comprised of the one-way spring 19 is provided in a direction in which the rotation of the take-up member 4 in the take-up direction is not transmitted to the take-up gear 18. Thus, in a state in which the rotation of the take-up member 4 is transmitted to the take-up gear 18 when the restraining member 14 comes into engagement with the gear portion 12*c* of the take-up driving member 12 and thereby the take-up driving member is in its immovable state, the rotation of the take-up member 4 is blocked, but the take-up rotation of the take-up member 4 alone is ensured by the one-way rotation transmitting mechanism comprised of the one-way spring 19.

When conversely, the gear portion 12*c* is rotated in the direction of arrow k by the drive force of the take-up driving member 12, the take-up gear 18 is rotated in the take-up direction of arrow 1 and the one-way spring 19 transmits the rotation of the take-up gear 18 in the direction of arrow 1 to the take-up member 4. However, the one-way spring 17 does not transmit the rotation of the take-up member 4 to the take-up lever 23 and therefore, the take-up of the toner seal 5 can be effected by the rotational force of the take-up driving member 12.

As described above, by the take-up lever 23 being rotated in the direction of arrow j, the peeling start portion of the toner seal 5 can be reliably peeled and therefore, thereafter the restraining member 14 is released and the take-up of the toner seal 5 can be sufficiently effected even by only the rotative force of the take-up driving member 12.

In the present embodiment, a projected portion 51*c* for bearing against the take-up lever 23 to thereby rotate the take-up lever 23 in the direction of arrow j when the process cartridge 100 is inserted into the apparatus body 200 is provided in the apparatus body 200. This projected portion 51*c* is provided at a position whereat the restraining member 14 gives the take-up member 4 the rotation sufficient to peel the peeling start portion of the toner seal 5 before it comes into engagement with the releasing member 50.

Accordingly, when the insertion of the process cartridge 100 into the apparatus body 200 is started, the take-up lever 23 first bears against the projected portion 51*c* and by the rotation of the take-up lever 23 in the direction of arrow j, the take-up member 4 is rotated through the one-way spring 17 and begins to peel the peeling start portion of the toner seal 5 over the full width thereof. At this time, the rotative force relative to the take-up lever 23 is obtained from the inserting force with which the process cartridge 100 is inserted into the apparatus body 200 and therefore, the peeling start portion of the toner seal 5 can be reliably peeled. Then, the restraining member 14 comes into engagement with the releasing member 50 and by the drive force of the take-up driving member 12, the toner seal 5 of which the peeling start portion has already been peeled is automatically taken up onto the take-up member 4.

In each of the above-described embodiments, as regards the toner in the toner container 2, there is taken as an example the system in which when the toner seal is peeled, all the toner seal including the portion thereof heat-welded around the toner supply opening 2*f* is peeled. However, the present invention is not restricted to this, but may adopt a system comprised of flexible first film (hereinafter referred to as the "seal film") breakable in the lengthwise direction thereof which covers the opening formed between the toner container and the developing device, and thin belt-like second film (hereinafter referred to as the "tear tape") tearing the seal film in the lengthwise direction thereof to thereby form a toner supply opening. As the base material of this seal film, use is made of compound film of polyester aluminum, uniaxially oriented polypropylene or the like.

Also, the peeling start portion of the toner seal 5 is welded with the same width (D) as the width of the toner seal 5, as shown in FIG. 12, but alternatively, there may be adopted a system in which the welding of the toner seal in the peeling start portion is inclined along the direction of peeling and the force at the start of peeling can be concentrated in the inclined end of the toner seal to thereby effect peeling easily (an easy peeling system).

As the process cartridge, there is shown an example in which the photosensitive drum 21, the charger 22, the developing device 1 and the cleaning device 31 are made integral with one another, but alternatively, the process cartridge may be one in which the charging means, the developing means or the cleaning means as process means and the electrophotographic photosensitive member are integrally made into a cartridge which is removably mountable in the image forming apparatus body, one in which at least one of the charging means, the developing means and the cleaning means as process means and the electrophotographic photosensitive member are integrally made into a cartridge which is removably mountable in the image forming apparatus body, or one in which at least the developing means as process means and the electrophotographic photosensitive member are integrally made into a cartridge which is removably mountable in the image forming apparatus body. Here, the term "image forming apparatus" covers, for example, an electrophotographic copying apparatus, an electrophotographic printer (such as a laser beam printer or an LED printer), an electrophotographic facsimile apparatus, etc.

As previously described, the toner container 2 for containing therein the toner used for development by the developing means (developing device 1) for developing the latent image formed on the electrophotographic photosensitive member (photosensitive drum 21), the developing means being supported by the developing frame (housing member 3), the toner container being mounted in the electrophotographic image forming apparatus 200, has a toner frame (toner container 2) having a toner containing portion 2*a* containing the toner therein, a toner supply opening 2*f* for supplying the toner 7 contained in the toner containing portion to the developing means, a toner seal 5 for unsealably sealing the toner supply opening, a take-up member 4 for taking up the toner seal, the take-up member 4 being disposed in a space (a take-up member containing portion 2*h*) formed by the developing frame and the toner frame being coupled together, and drive force imparting means (the handle 6, the gear 16 and the one-way spring 17) for imparting a drive force to the take-up member.

The space (the take-up member containing portion 2*h*) in which the take-up member 4 is disposed is provided on one end side in the lengthwise direction of the developing roller 10 of the developing means (developing device 1) supported by the developing frame (housing member 3). Also, the space is comprised of a recess (take-up member containing portion 2*h*) formed integrally with the toner frame (toner container 2), and a developing frame (housing member 3) portion provided in opposed relationship with the recess, a gap G for the toner seal 5 to pass therethrough is provided between the toner frame and the developing frame, and the toner seal 5 taken up by the take-up member 4 passes through the gap G.

Further, the take-up member 4 is of a cylindrical shape and is disposed in a direction intersecting the lengthwise direction of the developing roller 10 of the developing means. Also, a portion of the toner frame forming the space is formed of a transparent member (window portion 2*g*), through which the take-up member 4 disposed in said space can be seen from outside.

Also, the drive force imparting means is disposed outside the space, and imparts to the take-up member 4 a drive force for the take-up member 4 to take up the toner seal 5. The drive force imparting means has a rotatable member (handle 6) manually rotated. The rotatable member has a handle 6, of which the operating radius is larger than the radius of the take-up member 4.

Also, according to another embodiment, the drive force imparting means has a gear 16 which meshes with a toothed guide 52 provided in the image forming apparatus 200 when the toner container is mounted in the electrophotographic image forming apparatus 200, and which is rotated by the movement thereof relative to the guide 52, and the take-up member 4 is rotated by this rotative force.

Also, according to another embodiment, the drive force imparting means has an energy accumulating member (take-up spring 13) accumulating a drive force therein, and the energy accumulating member accumulates a force therein when the toner container is mounted in the electrophotographic image forming apparatus 200. The toner seal 5 is taken up onto the take-up member 4 by the force accumulated in the energy accumulating member.

According to the above-described embodiments, the seal member after unsealing is taken up onto the take-up member in the hermetically sealed space and therefore, the developer does not leak out of the apparatus. Also, there is no excess load for the take-up member to take up the seal member and therefore, the seal member can be reliably taken up.

Also, according to the above-described embodiments, the formation of the hermetically sealed space is easy and the coupling of the developer container and the developing device can be made firm, and there will be no problem in the hermetically sealing property even if the apparatus is subjected to shock during the transportation thereof. Further, the coupling of the developer container and the developing device can be accomplished easily. Furthermore, the take-up member can be rotated from the outside of the apparatus.

Still further, the take-up member can be manually rotated to thereby unseal the seal. Yet still further, the unsealing of the seal can be accomplished by a light manual operating force. Further, the take-up member can be automatically rotated by the use of an extraneous driving mechanism or the like to thereby accomplish the unsealing of the seal. Still further, for example, the unsealing of the seal can be automatically effected simply by moving the developing device. Yet still further, the automatic unsealing of the seal can be realized by the mechanism in the hermetically sealed space. Furthermore, the forcibly rotatable member is rotated, whereby a strong peeling force at the early stage of the unsealing of the seal member is obtained, whereafter the automatic unsealing of the seal can be accomplished by the accumulated force of the accumulated energy holding member.

What is claimed is:

1. An apparatus for containing a toner to be used by a developing member for developing a latent image formed on an electrophotographic photosensitive member, and being mounted in an electrophotographic photosensitive image forming apparatus, said apparatus comprising:

a developer housing supporting the developing member;

a toner container having a toner containing portion containing the toner therein;

a toner supply opening for supplying the toner contained in said toner containing portion to the developing member;

a toner seal for openably sealing said toner supply opening;

a take-up member for taking up said toner seal, said take-up member being disposed in a space surrounded by said developer housing and said toner container coupled together;

a passage for guiding said toner seal to said take-up member, said passage being disposed between said toner container and said developer housing and connected to the space in which said take-up member is disposed; and a drive force imparting member for imparting a drive force to said take-up member to take up said toner seal.

2. An apparatus according to claim 1, wherein the space in which said take-up member is disposed is provided at one end of said apparatus in a lengthwise direction of a developing roller of the developing member supported by the developer housing.

3. An apparatus according to claim 2, wherein the space is formed by a recess formed integrally with said toner container, and a developing frame portion opposed to said recess, and wherein a gap for said toner seal taken up by said take-up member to pass therethrough is provided between said toner container and the developer housing.

4. An apparatus according to claim 3, wherein said take-up member is of a cylindrical shape and is disposed in a direction intersecting with the lengthwise direction of the developing roller of the developing member.

5. An apparatus according to claim 4, wherein a portion of said toner container forming the space is formed of a transparent member, through which said take-up member disposed in the space can be seen from outside.

6. An apparatus according to claim 1 or 3, wherein said drive force imparting member is disposed outside the space.

7. An apparatus according to claim 6, wherein said drive force imparting member has a rotatable member that is manually rotatable.

8. An apparatus according to claim 7, wherein said rotatable member has a handle, of which an operating radius is larger than a radius of said take-up member.

9. An apparatus according to claim 6, wherein said drive force imparting member has a gear adapted to mesh with a toothed guide provided in the image forming apparatus when said apparatus is mounted to the image forming apparatus, and adapted to be rotated by movement thereof relative to said toothed guide to thereby rotate said take-up member.

10. An apparatus according to claim 6, wherein said drive force imparting member has an energy accumulating member that accumulates a drive force therein when said toner container is mounted in the image forming apparatus, and wherein said toner seal is taken up onto said take-up member by said drive force.

11. An apparatus according to claim 1, wherein the developer housing and said toner container are coupled together by one of welding and an adhesive agent.

12. An apparatus according to claim 1, wherein said toner seal is one of an easy peel type which peels all portions covering said toner supply opening to open said toner supply opening, and a tear type which tears a portion covering said toner supply opening to open said toner supply opening.

13. A process cartridge removably mountable to a main body of an electrophotographic photosensitive image forming apparatus, said process cartridge comprising:

a. an electrophotographic photosensitive member;

b. a developing member for developing a latent image formed on said electrophotographic photosensitive member;

c. a developer housing supporting said developing member; and d. a toner container for containing toner to be used for development by said developing member, said toner container having a toner frame including a toner containing portion containing the toner therein, a toner supply opening for supplying the toner contained in said toner containing portion to said developing member, a toner seal for openably sealing said toner supply opening, a take-up member for taking up said toner seal, said take-up member being disposed in a space surrounded by said developer housing and said toner frame coupled together, a passage for guiding said toner seal to said take-up member, said passage being disposed between said toner frame and said developer housing and connected to the space in which said take-up member is disposed, and a drive force imparting member for imparting a drive force to said take-up member to take up said toner seal.

14. A process cartridge according to claim 13, wherein the space in which said take-up member is disposed is provided at one end of said toner container in a lengthwise direction of a developing roller of said developing member supported by said developer housing.

15. A process cartridge according to claim 14, wherein the space is formed by a recess formed integrally with said toner frame, and a developing frame portion opposed to said recess, and wherein a gap for said toner seal taken up by said take-up member to pass therethrough is provided between said toner frame and said developer housing.

16. A process cartridge according to claim 15, wherein said take-up member is of a cylindrical shape and is disposed in a direction intersecting with the lengthwise direction of said developing roller of said developing member.

17. A process cartridge according to claim 16, wherein a portion of said toner frame forming the space is formed of a transparent member, through which said take-up member disposed in the space can be seen from outside.

18. A process cartridge according to claim 13 or 15, wherein said drive force imparting member is disposed outside the space.

19. A process cartridge according to claim 18, wherein said drive force imparting member has a rotatable member that is manually rotatable.

20. A process cartridge according to claim 19, wherein said rotatable member has a handle, of which an operating radius is larger than a radius of said take-up member.

21. A process cartridge according to claim 18, wherein said drive force imparting member has a gear adapted to mesh with a toothed guide provided in the image forming apparatus when said toner container is mounted to the image forming apparatus, and adapted to be rotated by movement thereof relative to said toothed guide to thereby rotate said take-up member.

22. A process cartridge according to claim 18, wherein said drive force imparting member has an energy accumulating member that accumulates a drive force therein when said toner container is mounted in the image forming apparatus, and wherein said toner seal is taken up onto said take-up member by said drive force.

23. A process cartridge according to claim 13, wherein said developer housing and said toner frame are coupled together by one of welding and an adhesive agent.

24. A process cartridge according to claim 13, wherein said toner seal is one of an easy peel type which peels all portions covering said toner supply opening to open said toner supply opening, and a tear type which tears a portion covering said toner supply opening to open said toner supply opening.

25. A process cartridge according to claim 13, further comprising a charging member for charging said electrophotographic photosensitive member.

26. A process cartridge according to claim 13 or 25, further comprising a cleaning member for removing any toner remaining on said electrophotographic photosensitive member.

27. An electrophotographic photosensitive image forming apparatus, for forming an image on a recording medium, on which a process cartridge is removably mountable, said image forming apparatus comprising:

a. mounting means for removably mounting the process cartridge, which includes an electrophotographic photosensitive member, a developing member for developing a latent image formed on said electrophotographic photosensitive member, a developer housing supporting the developing member, and a toner container for containing toner to be used for development by said developing member, said toner container having a toner frame including a toner containing portion containing the toner therein, a toner supply opening for supplying the toner contained in said toner containing portion to said developing member, a toner seal for openably sealing said toner supply opening, a take-up member for taking up said toner seal, said take-up member being disposed in a space formed by said developer housing and said toner frame coupled together, a passage for guiding said toner seal to said take-up member, said passage being disposed between said toner frame and said developer housing and connected to the space in which said take-up member is disposed, and a drive force imparting member for imparting a drive force to said take-up member to take up said toner seal; and b. conveying means for conveying the recording medium.

28. An apparatus for containing a toner to be used for development by a developing roller for developing a latent image formed on an electrophotographic photosensitive drum, the developing roller being rotatably supported by a developer housing, and said apparatus being mounted in an electrophotographic photosensitive image forming apparatus, said apparatus comprising:

a developer housing supporting the developing roller;

a toner container having a toner containing portion containing the toner therein;

a toner supply opening for supplying the toner contained in said toner containing portion to the developing roller;

a toner seal for openably sealing said toner supply opening;

a take-up member, disposed in a space surrounded by said developer housing and said toner container coupled together, for taking up said toner seal, said take-up member being of a cylindrical shape and disposed in a direction intersecting with a lengthwise direction of the developing roller, and the space being provided at one end of said toner container in the lengthwise direction of the developing roller supported by said developer housing;

a passage for guiding said toner seal to said take-up member, said passage being disposed between said toner container and said developer housing and connected to the space in which said take-up member is disposed; and a drive force imparting member disposed outside the space for imparting a rotative force to said take-up member, wherein a portion of said toner container forming the space is formed of a transparent member, through which said take-up member disposed in the space can be seen from outside.

29. An apparatus for containing a toner to be used for development by a developing roller for developing a latent image formed on an electrophotographic photosensitive drum, the developing roller being rotatably supported by a developer housing, and said apparatus being mounted in an electrophotographic photosensitive image forming apparatus, said apparatus comprising:

a developer housing supporting the developing roller;

a toner container having a toner containing portion containing the toner therein;

a toner supply opening for supplying the toner contained in said toner containing portion to the developing roller;

a toner seal for openably sealing said toner supply opening;

a take-up member for taking up said toner seal, said take-up member being disposed in a space surrounded by said developer housing and said toner container coupled together;

a passage for guiding said toner seal to said take-up member, said passage being disposed between said toner container and said developer housing and connected to the space in which said take-up member is disposed, said take-up member being of a cylindrical shape and disposed in a direction intersecting with a lengthwise direction of the developing roller, and the space being provided at one end of said toner container in the lengthwise direction of the developing roller supported by said developer housing; and a drive force imparting member disposed outside the space for imparting a rotative force to said take-up member to take up said toner seal.

30. An apparatus according to claim 29, wherein the space is formed by a recess formed integrally with said toner container, and a developing frame portion opposed to said recess, and wherein a gap for said toner seal taken up by said take-up member to pass therethrough is provided between said toner frame and the developer housing.

31. An apparatus according to claim 29, wherein said drive force imparting member has a rotatable member that is manually rotatable.

32. An apparatus according to claim 31, wherein said rotatable member has a handle having an operating radius that is larger than a radius of said take-up member.

33. An apparatus according to claim 29, wherein said drive force imparting member has a gear adapted to mesh with a toothed guide provided in the image forming apparatus when said apparatus is mounted to the image forming apparatus, and adapted to be rotated by movement thereof relative to said toothed guide to thereby rotate said take-up member.

34. An apparatus according to claim 29, wherein said drive force imparting member has an energy accumulating member that accumulates a drive force therein when said toner container is mounted in the image forming apparatus, and wherein said toner seal is taken up onto said take-up member by said drive force.

35. An apparatus according to claim 29, wherein the developer housing and said toner container are coupled together by one of welding and an adhesive agent.

36. An apparatus according to claim 29, wherein said toner seal is one of an easy peel type which peels all portions covering said toner supply opening to open said toner supply opening, and a tear type which tears a portion covering said toner supply opening to open said toner supply opening.

37. A process cartridge removably mountable to a body of an electrophotographic photosensitive image forming apparatus, said process cartridge comprising:

a. an electrophotographic photosensitive drum;

b. a developing roller for developing a latent image formed on said electrophotographic photosensitive drum;

c. a developer housing supporting said developing roller;

d. a charging member for charging said electrophotographic photosensitive drum;

e. a cleaning member for removing any toner remaining on said electrophotographic photosensitive drum; and f. a toner container for containing toner to be used for development by said developing roller, said toner container having a toner frame including a toner containing portion containing the toner therein, a toner supply opening for supplying the toner contained in said toner containing portion to said developing roller, a toner seal for openably sealing said toner supply opening, a take-up member, disposed in a space surrounded by said developer housing and said toner frame coupled together, for taking up said toner seal, a passage for guiding said toner seal to said take-up member, said passage being disposed between said toner frame and said developer housing and connected to the space in which said take-up member is disposed, said take-up member being of a cylindrical shape and disposed in a direction intersecting a lengthwise direction of said developing roller, the space being provided on one side of said toner container in the lengthwise direction of said developing roller supported by said developer housing, and a drive force imparting member disposed outside the space for imparting a rotative force to said take-up member, wherein a portion of said toner frame forming the space is formed of a transparent member, through which said take-up member disposed in the space can be seen from outside.

38. A process cartridge removably mountable to a body of an electrophotographic photosensitive image forming apparatus, said process cartridge comprising:

a. an electrophotographic photosensitive drum;

b. a developing roller for developing a latent image formed on said electrophotographic photosensitive drum;

c. a developer housing supporting said developing roller;

d. a charging member for charging said electrophotographic photosensitive drum;

e. a cleaning member for removing any toner remaining on said electrophotographic photosensitive drum; and f. a toner container for containing toner to be used for development by said developing roller, said toner container having a toner frame including a toner containing portion containing the toner therein, a toner supply opening for supplying the toner contained in said toner containing portion to said developing roller, a toner seal for openably sealing said toner supply opening, a take-up member for taking up said toner seal, said take-up member being disposed in a space surrounded by said developer housing and said toner frame coupled together, a passage for guiding said toner seal to said take-up member, said passage being disposed between said toner frame and said developer housing and connected to the space in which said take-up member is disposed, said take-up member being of a cylindrical shape and disposed in a direction intersecting a lengthwise direction of said developing roller, the space being provided on one side of said toner container in the lengthwise direction of said developing roller supported by said developer housing, and a drive force imparting member disposed outside the space for imparting a rotative force to said take-up member to take up said toner seal.

39. A process cartridge according to claim 38, wherein the space is formed by a recess formed integrally with said toner frame, and a developing frame portion opposed to said recess, and wherein a gap for said toner seal taken up by said take-up member to pass therethrough is provided between said toner frame and said developer housing.

40. A process cartridge according to claim 37, wherein said drive force imparting member has a rotatable member that is manually rotatable.

41. A process cartridge according to claim 40, wherein said rotatable member has a handle, of which an operating radius is larger than a radius of said take-up member.

42. A process cartridge according to claim 37, wherein said drive force imparting member has a gear adapted to mesh with a toothed guide provided in the image forming apparatus when said toner container is mounted to the image forming apparatus, and adapted to be rotated by movement thereof relative to said toothed guide to thereby rotate said take-up member.

43. A process cartridge according to claim 37, wherein said drive force imparting member has an energy accumulating member that accumulates a drive force therein, when said toner container is mounted in the image forming apparatus, and wherein said toner seal is taken up onto said take-up member by said drive force.

44. A process cartridge according to claim 38, wherein said developer housing and said toner frame are coupled together by one of welding and an adhesive agent.

45. A process cartridge according to claim 37, wherein said toner seal is one of an easy peel type which peels all portions covering said toner supply opening to open said toner supply opening, and a tear type which tears a portion covering said toner supply opening to open said toner supply opening.

46. An electrophotographic photosensitive image forming apparatus, for forming an image on a recording medium, on which a process cartridge is removably mountable, said image forming apparatus comprising:

a. mounting means for removably mounting the process cartridge, which includes an electrophotographic photosensitive drum, a developing roller for developing a latent image formed on said electrophotographic photosensitive drum, a developer housing supporting said developing roller, a charging member for charging said electrophotographic photosensitive drum, a cleaning member for removing any toner remaining on said electrophotographic photosensitive drum, and a toner container for containing toner to be used for development by said developing roller, said toner container having a toner frame having a toner containing portion containing the toner therein, a toner supply opening for supplying the toner contained in said toner containing portion to said developing roller, a toner seal for openably sealing said toner supply opening, a take-up member for taking up said toner seal, said take-up member being disposed in a space surrounded by the developer housing and said toner frame coupled together, a passage for guiding said toner seal to said take-up member, said passage being disposed between said toner frame and said developer housing and connected to the space in which said take-up member is disposed, said take-up member being of a cylindrical shape and disposed in a direction intersecting a lengthwise direction of said developing roller, the space being provided on one side of said toner container in the lengthwise direction of said developing roller supported by said developer housing, and a drive force imparting member disposed outside the space for imparting a rotative force to said take-up member to take up said toner seal; and b. a conveying roller for conveying the recording medium.

47. An apparatus for containing a toner to be used by a developing member for developing a latent image formed on an electrophotographic photosensitive member, the developing member being supported by a developer housing, and said apparatus being mounted in an electrophotographic photosensitive image forming apparatus, said apparatus comprising:

a developer housing supporting the developing member;

a toner container having a toner containing portion containing the toner therein;

a toner supply opening for supplying the toner contained in said toner containing portion to the developing member;

a toner seal for openably sealing said toner supply opening;

a take-up member, disposed in a space surrounded by the developer housing and said toner container coupled together, for taking up said toner seal;

a passage for guiding said toner seal to said take-up member, said passage being disposed between said toner container and said developer housing and connected to the space in which said take-up member is disposed; and a drive force imparting member for imparting a drive force to said take-up member, wherein said take-up member is of a cylindrical shape and is disposed in a direction intersecting with the lengthwise direction of a developing roller of the developing member, and wherein a portion of said toner container forming the space is formed of a transparent member, through which said take-up member disposed in the space can be seen from outside.

48. A process cartridge removably mountable to a main body of an electrophotographic photosensitive image forming apparatus, said process cartridge comprising:

a. an electrophotographic photosensitive member;

b. a developing member for developing a latent image formed on said electrophotographic photosensitive member;

c. a developer housing supporting said developing member;

d. a toner container for containing toner to be used for development by said developing member, said toner container having a toner frame including a toner containing portion containing the toner therein, a toner supply opening for supplying the toner contained in said toner containing portion to said developing member, a toner seal for openably sealing said toner supply opening, a take-up member, disposed in a space surrounded by said developer housing and said toner frame coupled together, for taking up said toner seal, a passage for guiding said toner seal to said take-up member, said passage being disposed between said toner frame and said developer housing and connected to the space in which said take-up member is disposed, and a drive force imparting member for imparting a drive force to said take-up member, wherein said take-up member is of a cylindrical shape and is disposed in a direction intersecting with the lengthwise direction of a developing roller of said developing member, and wherein a portion of said toner frame forming the space is formed of a transparent member, through which said take-up member disposed in the space can be seen from outside.

49. A toner container for containing toner to be used by developing means for developing a latent image formed on an electrophotographic photosensitive member, the developing means being supported by a developing frame, and said toner container being mounted in an electrophotographic image forming apparatus, said toner container comprising:

a toner frame having a toner containing portion containing the toner therein;

a toner supply opening for supplying the toner contained in said toner containing portion to the developing means;

a toner seal for openably sealing said toner supply opening;

a take-up member for taking up said toner seal, said take-up member being disposed in a space formed by the developing frame and said toner frame coupled together, a passage for guiding said toner seal being formed in the space; and drive force imparting means for imparting a drive force to said take-up member to take up said toner seal, wherein the space in which said take-up member is disposed is provided at one end of said toner container in a lengthwise direction of a developing roller of the developing means supported by the developing frame, wherein the space is formed by a recess formed integrally with said toner frame, and a developing frame portion opposed to said recess, and wherein a gap for said toner seal taken up by said take-up member to pass therethrough is provided between said toner frame and the developing frame, wherein said take-up member is of a cylindrical shape and is disposed in a direction intersecting with the lengthwise direction of the developing roller of the developing means, and wherein a portion of said toner frame forming the space is formed of a transparent member, through which said take-up member disposed in the space can be seen from outside.

50. A process cartridge removably mountable to a main body of an electrophotographic image forming apparatus, said process cartridge comprising:

a. an electrophotographic photosensitive member;

b. developing means supported by a developing frame for developing a latent image formed on said electrophotographic photosensitive member; and c. a toner container for containing toner to be used for development by said developing means, said toner container having a toner frame including a toner containing portion containing the toner therein, a toner supply opening for supplying the toner contained in said toner containing portion to said developing means, a toner seal for openably sealing said toner supply opening, a take-up member for taking up said toner seal, said take-up member being disposed in a space formed by said developing frame and said toner frame coupled together, a passage for guiding said toner seal being formed in the space, and drive force imparting means for imparting a drive force to said take-up member to take up said toner seal, wherein the space in which said take-up member is disposed is provided at one end of said toner container in a lengthwise direction of a developing roller of said developing means supported by said developing frame, wherein the space is formed by a recess formed integrally with said toner frame, and a developing frame portion opposed to said recess, and wherein a gap for said toner seal taken up by said take-up member to pass therethrough is provided between said toner frame and said developing frame, wherein said take-up member is of a cylindrical shape and is disposed in a direction intersecting with the lengthwise direction of said developing roller of said developing means, and wherein a portion of said toner frame forming the space is formed of a transparent member, through which said take-up member disposed in the space can be seen from outside.

* * * * *

UNITED STATES PATENT AND TRADEMARK OFFICE

CERTIFICATE OF CORRECTION

PATENT NO. : 6,058,278
DATED : May 2, 2000
INVENTOR(S) : Tadayuki Tsuda, et al.

It is certified that error appears in the above-identified patent and that said Letters Patent is hereby corrected as shown below:

Title page,
Item [56] References Cited, FOREIGN PATENT DOCUMENTS, "1-31767" should read -- 1-316767 --.

Column 10,
Line 27, "photosensitive" should be deleted.
Line 56, "developing frame portion" should read -- portion of said developer housing --.

Column 11,
Line 62, "developing frame portion" should read -- portion of said developer housing --.

Column 12,
Lines 19 and 26, "toner container" should read -- process cartridge --.
Line 45, "photosensitive" should be deleted.
Line 63, "formed" should read -- surrounded --.

Column 13,
Lines 11 and 49, "photosensitive" should be deleted.
Line 13, "a" should read -- The --.
Line 51, "a" should read -- the --.
Line 66, "housing" should be deleted.

Column 14,
Line 12, "developing frame portion" should read -- portion of said developer housing --.
Line 44, "photosensitive" should be deleted.

Column 15,
Line 16, "photosensitive" should be deleted.
Line 53, "frame, and a developing frame portion" should read -- frame and a portion of said developer housing --.
Lines 57 and 63, "claim 37," should read -- claim 38, --.

Column 16,
Lines 3 and 11, "claim 37," should read -- claim 38, --.
Line 18, "photosensitive" should be deleted.
Line 62, "a" should read -- the --.

UNITED STATES PATENT AND TRADEMARK OFFICE

CERTIFICATE OF CORRECTION

PATENT NO. : 6,058,278
DATED : May 2, 2000
INVENTOR(S) : Tadayuki Tsuda, et al.

It is certified that error appears in the above-identified patent and that said Letters Patent is hereby corrected as shown below:

Column 17,
Line 22, "photosensitive" should be deleted.

Signed and Sealed this

Thirteenth day of November, 2001

*Attest:*

Nicholas P. Godici

NICHOLAS P. GODICI
*Acting Director of the United States Patent and Trademark Office*

*Attesting Officer*